United States Patent [19]

Leder

[11] 4,099,969

[45] Jul. 11, 1978

[54] COATING METHOD TO IMPROVE ADHESION OF PHOTOCONDUCTORS

[75] Inventor: Lewis B. Leder, Rochester, N.Y.

[73] Assignee: Xerox Corporation, Stamford, Conn.

[21] Appl. No.: 605,135

[22] Filed: Aug. 15, 1975

Related U.S. Application Data

[63] Continuation-in-part of Ser. No. 513,695, Oct. 10, 1974, abandoned, which is a continuation-in-part of Ser. No. 477,737, Jun. 10, 1974, abandoned.

[51] Int. Cl.[2] ..... B05D 3/06

[52] U.S. Cl. ..... 96/1.5 R; 204/164; 427/39

[58] Field of Search ..... 427/39; 96/1.5

[56] References Cited

U.S. PATENT DOCUMENTS

| | | | |
|---|---|---|---|
| 2,636,855 | 4/1953 | Schwarz | 204/164 |
| 3,290,567 | 12/1966 | Gowen | 204/164 |
| 3,419,487 | 12/1968 | Robbins et al. | 427/39 |
| 3,472,679 | 10/1969 | Ing et al. | 427/39 |
| 3,528,387 | 9/1970 | Hamilton | 427/39 |
| 3,816,288 | 6/1974 | Lubicz et al. | 204/164 |

FOREIGN PATENT DOCUMENTS

| | | | |
|---|---|---|---|
| 1,065,745 | 4/1967 | United Kingdom | 204/164 |

*Primary Examiner*—John H. Newsome
*Attorney, Agent, or Firm*—J. J. Ralabate; J. P. O'Sullivan

[57] ABSTRACT

A photoreceptor having improved flexibility and durability comprising a metal- or metal-coated substrate and an inorganic photoconductor layer in charge blocking contact with the substrate, the photoreceptor being obtained by initially bombarding a grounded or floating substrate with electrons and non-metallic high energy ions in the presence of oxygen and exposing the resulting clean oxide-coated substrate to a vapor cloud of photoconductor material bombarded by electrons and non-metallic ions to form high energy ions, the vapor cloud being initially obtained by evaporation from a crucible in a coated under glow discharge conditions; the latter functional step being optionally effected in combination with at least part of the initial bombardment step.

16 Claims, 6 Drawing Figures

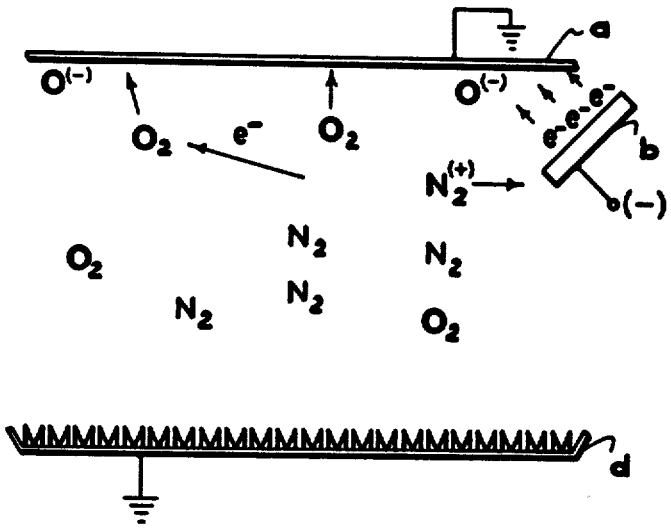
a
b
c
d
O(-)
O2
e-
N2(+)
(-)
N2
MMMM

COATING METHOD TO IMPROVE ADHESION OF PHOTOCONDUCTORS

BACKGROUND OF THE INVENTION

This application is a continuation-in-part of U.S. Ser. No. 513,695, filed on Oct. 10, 1974, which is in turn a continuation-in-part of U.S. Ser. No. 477,737, filed on June 10, 1974, entitled "Coating Method To Improve Adhesion of Photoconductors" both now abandoned, and relates to improved photoreceptors utilizing flexible substrates and relatively brittle heavy ionizable inorganic photoconductive material, the photoreceptor being obtained in accordance with an oxidation deposition process.

Photoreceptors, particularly those related to the xerographic copying, traditionally comprise a photoconductive insulating layer such as an ionizable element or alloy thereof exemplified by selenium (amorphous or trigonal) and selenium alloys such as a selenium-arsenic alloy with varying amounts of a halogen. Such materials are customarily applied in charge blocking contact to a supporting metal-or-covered charge-conductive substrate. Suitable substrates for such purpose include, for instance, aluminum, steel, nickel, brass, NESA glass or corresponding metal-coated polymeric materials.

Photoreceptors comprising at least the above components are generally given a uniform electrostatic charge and the sensitized surface then exposed to an image pattern defined by an electromagnetic radiation, such as light. Light impingement results in a selective dissipation of the initial applied charge leaving a positive electrostatic image. The electrostatic image is then customarily developed by applying oppositely charged electroscopic marking particles onto the charge-bearing photoreceptor surface.

The above basic concept was originally described by Carlson in U.S. Pat. No. 2,297,691, and has been since amplified and redescribed in many related patents in the field. Generally speaking, however, photoconductive layers suitable for carrying out the above functions have a specific resistivity of about $10^{10} - 10^{13}$ ohm-cm, in the absence of illumination. In addition, their resistivity must drop at least several orders of magnitude where exposed to an activating radiation such as light.

Photoreceptors meeting the above criteria also normally exhibit some loss in applied charge, even in the absence of light exposure. This phenomenon is known as "dark decay" and will vary somewhat with sensitivity and with usage of the photoreceptor. The existence of the problem of "dark decay" is well known and has been controlled to a substantial extent by incorporation of thin barrier layers such as a dielectric film between the base of substrate and the photoconductive insulating layer U.S. Pat. No. 2,901,348 of Dessauer et al utilizes a film of aluminum oxide of about 25 to 200 angstroms or a 0.1 – 2$\mu$ insulating resin layer, such as a polystyrene for such purpose. With some limitations, these barrier layers function to allow the photoconductive layer to support a charge of high field strength while minimizing "dark decay". When activated by illumination, however, the photoconductive layer and barrier layer must become sufficiently conductive to permit substantial dissipation of the applied charge in light-struck areas within a short period of time.

In addition to the above-indicated electrical requirements, it is also becoming increasingly important that photoreceptors meet rather stringent requirements with regard to mechanical properties such as flexibility and durability. Such additional criteria become particularly important in modern automatic copiers operating at high speeds where the photoreceptor is in the form of an endless flexible belt (ref. U.S. Pat. No. 2,691,450). While belt-type photoreceptors have many advantages, there are also serious technical problems inherent in their use. For example, high speed machine cycling conditions require particularly strong adhesion between the photoconductive layer and the underlying substrate. Unfortunately, however, some of the nost sensitive and efficient photoconductive materials are relatively brittle as films and do not generally adhere well to flexing metal substrates having a good charge blocking contact. It is very important that any interface between the electrically conductive supporting substrate and the photoconductive layer be stable and strongly adherent to both since charges at this point will have a substantial effect on the electrical properties of the photoreceptor.

The above problems have been considered and resolved to a substantial extent in a process described in a copending application filed on June 10, 1974, by Lewis B. Leder, John C. Schottmiller and Harold H. Schroeder entitled "Improved Photoreceptor Fabrication" (U.S. Ser. No. 477,736 now abandoned) wherein the substrate (cathode) is initially bombarded by non-metallic ions under a DC glow discharge in the presence of air or an inert rare gas containing at least 1% by volume available oxygen. This step is then followed or overlapped by further exposure of the substrate (cathode) with a mixture of non-metallic high energy cations of an inert gas such as nitrogen or argon, uncharged vaporized photoconductive material and high energy ions of the photoconductive material. While the above-described process represents a substantial technical breakthrough in utilizing the more efficient brittle photoconductors in flexible belt-type photoreceptors, there still remains room for substantial improvement. In particular, the production of high energy photoconductive cations in a glow discharge for bombardment purposes is relatively inefficient (up to about 5% ion production at best) and requires expensive electrical equipment of limited capacity to maintain a suitable electrical field.

It is an object of the present invention to obtain improved durable photoreceptors suitable for high speed xerographic copying purposes.

It is a further object of the present invention to develop a new method for successfully utilizing brittle photoconductive elements in a class of high speed flexible photoreceptors without the need for complicated chemical pretreatment of the substrate to obtain good blocking contact, durability and flex.

BRIEF DESCRIPTION OF THE DRAWING

Each of the FIGURES of the drawing illustrates a manner of applying a glow discharge of a substrate to carry out the cleaning, oxidizing and/or coating of the substrate.

THE INVENTION

Figure 1C:
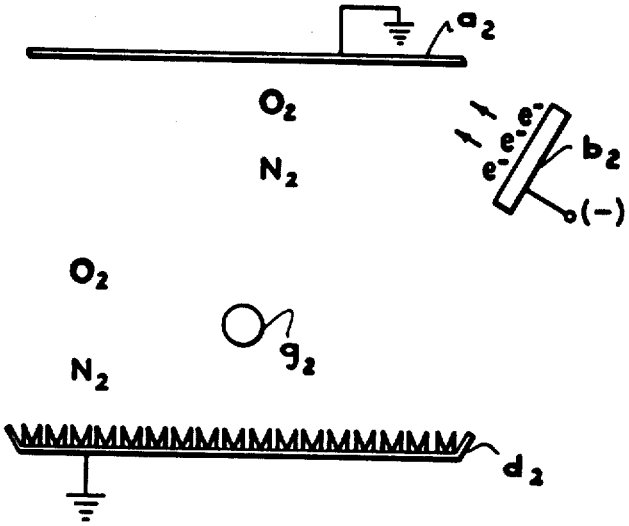

These and other objects of the instant invention are achieved in obtaining flexible photoreceptors having improved durability and adhesion between a metal- or metal-coated substrate thereof and a photoconductor layer thereof containing inorganic photoconductive material in charge blocking contact with the substrate by exposing clean oxide-coated substrate to a vapor cloud contaning photoconductive material from a donor source, said vapor cloud comprising both uncharged photoconductive material and high energy ions of photoconductive material from a glow discharge, the high energy ions being substantially obtained by heating the doner source to effect vaporization of photoconductive material, and bombarding the resulting vapor cloud with electrons and/or gas ions in the glow discharge.

While numerous modifications are possible, the initial step of obtaining a clean-oxidized substrate is most conveniently obtained by first bombarding the substrate with electrons and gas ions created under glow discharge in the presence of air or a mixture of oxygen with at least one inert non-metallic ion-forming gas such as nitrogen, argon, xenon, etc., and then exposing the resulting oxidized substrate to a high energy ion-containing photoconductor vapor cloud as described above.

In any case, most suitable photoreceptors include at least one thin oxide charge blocking layer in general accordance with U.S. Pat. No. 2,901,348 or as otherwise obtained. When flexible metal belts such as nickel belts are used as substrates, however, special chemical treatment is sometimes required in order to obtain a suitable intermediate charge blocking layer.

Depending upon the nature of the substrate, plus the charge, shape, and positioning of the electrode, the important step of exposure of oxide-coated substrate to the vapor cloud can be effected subsequently or even in conjunction with at least part of the initial substrate cleaning and oxidation bombardment step, provided electrical rather than chemical pre-treatment is utilized.

Suitable substrates for purposes of the present invention can usefully include relatively thin layers or metal foils of copper, steel, brass, aluminum, zinc, nickel or corresponding metal-coated flexible polymeric bases such as a coated polyethylene terephthalate. Of particular interest are aluminum-coated polyethylene terephthalate belts and nickel belts.

Photoconductive material suitable for use in the instant process generally includes inorganic ionizable elements such as selenium, selenium alloys inclusive of alloys of selenium with tellurium, germanium, antimony, bismuth and arsenic and/or one or more halogens such as chlorine, bromine, or iodine. Such photoconductive materials are obtainable, for instance, by subjecting selenium plus small amounts of arsenic, etc., and halogen to heat.

Satisfactory adhesion of brittle inorganic photoconductor material such as above defined, to flexible metal substrates as above defined can now be satisfactorily accomplished more easily and with better results in accordance with specific embodiments of the present invention.

The initial bombardment of a substrate with electrons and ions of a non-metallic gas to clean and oxidize is best carried out, for instance, by evacuating a suitable modified vacuum coater down to a pressure of about $5 \times 10^{-5}$ Torr or better and then backfilling to about 5 - 30 microns (mercury) pressure. A pressure of about 10 - 20 microns is generally preferred, however, for this purpose. While air under reduced pressure is acceptable, it is also found convenient to utilize various alternative mixtures of positive ion-producing and oxidizing gases at comparable pressures. Such include, for instance, argon-oxygen, argon-air, argon-$CO_2$, or a mixture of pure nitrogen and oxygen, etc., provided the amount of available oxygen for initial oxidation of the substrate is not less than about 1% by volume of the available gases, and provided a glow discharge can be maintained.

In accordance with the present invention, it is also found that the above-described initial ion bombardment of the grounded or floating substrate is best carried out directly under a "glow cathode" (FIGS. IA and IC) such as an aluminum cathode at a potential up to about 5000 volts with respect to the substrate and at about 300 - 5000 volts, depending upon the type and pressure of gas used to form the bombarding ions.

Prior to or immediately after completion of a period of time sufficient to lay down an oxide barrier layer of about 10 - 200 angstrom thickness and heat the substrate to a temperature of about 55°-80° C. (about 5 - 20 minutes and preferably 8 - 10 minutes under conditions indicated above), the oxide-bearing substrate is exposed to bombardment by a cloud comprising uncharged and ionic photoconductive particles evolved from the heated photoconductor source, the vapor cloud obtained therefrom having been exposed to electron- or indirectly to gaseous-ion bombardment to obtain a minor amount of ions of the evaporant photoconductor material. In such situations, the simultaneous overlapping substrate bombardment by non-metallic ions such as argon or nitrogen created by a glow cathode, etc. will tend to displace more loosely adherent condensed photoconductive particles already laid down on the substrate in favor of ionic photoconductor particles having much greater velocity and energy content than the vaporized uncharged photoconductor material. This occurs despite the relatively low concentrations of photoconductor ions obtained relative to the total amount of thermally created photoconductive particles.

For purposes of the present invention, depositions onto clean oxidized substrate is best effected by separately heating the photoconductor donor source to a temperature between room temperature and the maximum evaporation temperature of the photoconductive material. For such purpose, the preferred temperature range (1) favors maximum vapor concentration and field conditions commensurate with maintenance of a glow discharge pressure proximate to the heated photoconductive source and the substrate, and (2) favors the highest possible conversion of uncharged to charged (ions) photoconductor material to effect the impaction of the largest possible concentration of high energy photoconductor particles onto the substrate.

While various arrangements of electrodes and donor sources are acceptable for this purpose, the most promising to date are shown in diagrammatic cross-section (ref. FIGS. IB, ID, IF).

One particularly preferred arrangement utilizes at least one high voltage electrode such as a rod or wire conveniently mounted on insulators between the donor source such as a heated crucible and the substrate, and negative with respect thereto. Such an arrangement can include, for instance, one or more electrodes above and in parallel long axial arrangement with respect to at least one heated photoconductor-material-containing crucible boat. In the case of a plurality of crucible boats this can also include an electrode above each lip or shared between the above the lips of adjacent crucibles in a coater (ref. FIGS. IC - IF).

Another suitable arrangement for obtaining high energy ions of photoconductive material reguires aiming the charged particles from at least one glow cathode into the vapor cloud produced by the donor source (ref. FIG. IB).

In addition to the above-described physical arrangement of the coating components it is also important in some embodiments that an adequate concentration of ions be maintained along with charged photoconductive particles.

As a practical matter, the initial treatment of a metal substrate (ref. FIGS. IA, IC, IE) is best effected in a pressure of about 5 - 30 microns, the amount of oxygen present being not less than about 1% by volume of available gases. In the subsequent photoconductor deposition step (ref. FIGS. IB, ID, IF), however, it is sometimes desirable to increase the amount of vacuum to about $5 \times 10^{-5}$ Torr or better and then backfill the coating chamber with a pressure of up to about 1 - 30 microns of argon, nitrogen, xenon or similar inert gases.

In order to effectively raise the vapor pressure of the photoconductive material for deposit onto the oxidized substrate, the photoconductor source is conveniently heated by a number of different ways. Such include, for instance, resistance heating of one or more crucibles or boats containing the photoconductor material, the use of an electron beam or gun directed at the unvaporized photoconductor material of the donor source, or even by ion beam heating of the photoconductor material. In any case, the optimum temperatures will vary with the photoconductive material, the distance between source and substrate and the atmospheric composition and pressure utilized.

By way of example, a crucible temperature up to about 350° C. and preferably about 180° C - 300° C. is found adequate for vaporizing selenium and most of the known selenium alloys under a pressure up to about 30 microns.

During the period of photoconductor deposition onto the clean oxide-coated substrate, it is essential that a glow discharge be maintained for the purpose of creating high energy photoconductor ions without seriously limiting the rate and area of deposition of the photoconductive material onto the substrate.

As previously indicated, the relationship of the electrodes and other essential components for carrying out the inventive process are very generally represented in diagrammatic cross-section in FIGS. IA - IE. In FIG. IA, in particular, the elements (a) and (d) respectively, represent a metal substrate and a photoconductor donor source (i.e., a crucible containing photoconductor material "M") within a vacuum coater (not shown); element (b) represents one or more aluminum glow cathodes in proximity to the substrate and preferably activated under an atmospheric pressure of about 10 - 20$\mu$ to effect the heating and oxidation of the substrate as desired. The step, as described, is conveniently effected by initial exposure of the substrate (a) to a high voltage glow cathode discharge of about 3,000 - 5,000 volts.

The nezt step is conveniently represented in diagrammatic cross-section by FIG. IB in which ($a_1$) represents the oxidized metal substrate, (d) represents the photoconductor source but lacking some photoconductor material (M) due to evaporation, and elements (c) and (f) respectively represent a negative glow cathode and a positive target electrode. These two figures represent a dynamic situation in which the first glow discharge (FIG. IA) is optionally turned off after establishing a uniform clean oxidized substrate surface while one or more high voltage glow cathodes (c) are activated to establish a glow region between (c) and (f) for the purpose of producing high energy photoconductor ions from the heated crucible (d). Alternatively, the second step can be achieved by altering the position or aim of glow cathode (b) in FIG. IA provided a grounded target electrode such as (f) is provided. A grounded metal wall of the vacuum coater can act in the capacity. In carrying out that described second step, the pressure inside the vacuum coater is preferably kept at about 10 - 20 microns and the donor crucible (d) preferably heated to about 180°- 300° C. as before mentioned to obtain an adequate vapor cloud of photoconductor material. In any case, the second step is carried out so that the glow (ionization of the non-metallic gas atmosphere) occurs in a convenient location to intercept vaporized photoconductor material somewhere between the donor crucible and the substrate.

As desired, after depositing photoconductive material under glow discharge to a thickness of at least about 0.01$\mu$ and preferably after depositing about 0.5% - 10% by weight onto the oxidized substrate (i.e., about 2 - 5 minutes), pressure is conveniently lowered in the coater to $5 \times 10^{-5}$ Torr or better, and vapor deposition of the balance of the photoconductor material optionally allowed to proceed by vacuum deposition alone in the usual manner. For xerographic purposes, a total photoconductor coating of about 40 - 60$\mu$ on the substrate is optional, although not exclusive. In most cases, only a relatively minor amount (a maximum of about 5% by weight) of the total exposed evaporant for deposition on the substrate is ionized.

While air under reduced pressure is preferred for purposes of the above-described process, it is also possible to utilize argon or similar inert gases provided at least 1% by volume of oxygen is present in the initial oxidation step.

By effecting the second deposition stage (ref. FIG. IB) in the presence of positive non-metallic ions such as nitrogen or argon, it is possible to displace a substantial amount of accompanying low-energy-deposited photoconductor material from the substrate in favor of the available charged high energy photoconductor ions. The efficiency of this process can be improved either by allowing the substrate to "float" (not connected to ground) or by applying to the substrate a low volate (100 - 500 volt) positive with respect to the grounded chamber.

Successful impact deposition, therefore, often reguires a balance between removal and deposition rate so as to obtain a net coating action. The time required to obtain an adequate photoconductive layer will largely depend on these factors.

As earlier noted, the chief advantage of depositing ionized vitreous photoconductor on a metallic substrate is realized in improved durability, adhesion and improved interface electrical properties; to achieve these properties it is necessary only to deposit at least a fraction of the entire photoconductor thickness in the high energy ionic state. Depending upon the photoconductor deposition schedule, it is also sometimes very helpful if the oxide-coated substrate is exposed to a glow discharge both prior to and during at least some exposure to the vapor cloud of photoconductive material. If desired, however, the entire photoconductive layer may be deposited in the manner previously decribed.

A further modification of the procedure outlined above, and one which is particularly noteworthy with respect to reduced power demands, is again represented in diagrammatic cross-section in FIGS. IC, ID, IE and IF in which elements ($a_2$) and ($a_4$) respectively represent a precleaned metal substrate or base such as nickel or aluminum which is then initially heated and oxidized by glow cathodes ($b_2$) and ($b_3$) under partial vacuum (FIGS. IC and IE) or by other standard means. Crucible boats ($d_2$) and ($d_3$), contain suitable amounts of photoconductive material "M" and are equipped with heating means (not shown) and conveniently positioned beneath substrates ($a_2$) and ($a_3$) in convenient parallel axial arrangement to rod or wire electrodes ($g_2$) and ($g_3$) of solid or tubular construction of convenient diameter which are activated by negative high voltage under reduced pressure (FIGS. ID and IF) to effect a glow discharge area between crucibles ($d_2$) and ($d_3$) and the corresponding oxidized substrates ($a_3$) or ($a_5$). Just prior to or in conjunction with the glow discharge, the heating means of crucibles ($d_2$) and ($d_3$) are activated to vaporize the photoconductive material and to obtain desired high energy photoconductive ions ($M^-$) as well as unchanged photoconductive material (M) for impact with the oxidized substrate. Both the substrates and crucibles can be conveniently grounded as shown or the substrate can be permitted to float. In addition, the cathode rods need not be equidistant from each crucible, particularly where a plurality of substrates are being treated in a single coater (ref. FIGS. IE and IF).

While various sized rods or wires and various materials and distances can be utilized to obtain an adequate glow discharge, it is found particularly useful to use a 1/16 inch - ½ inch diameter solid stainless steel, aluminum or tungsten rod of indeterminate length, suspended about 0.25 inch - 4 inches above one or more 5 inches to 100 inches crucibles in parallel arrangement and about 2 inches - 30 inches below the substrate(s) to be coated. Other combinations of spacing are possible depending upon the pressure, rod diameter and crucible temperature, etc.

Referring more specifically to the procedures represented in FIGS. IC - IF, when the substrate is at a suitable temperature for depositing photoconductor material thereon, the glow discharge is turned off as previously described with respect to FIGS. IA - IB and a glow discharge instituted by activating the cathode rod ($g_2$) or ($g_3$) under an atmosphere of about 5 - 20$\mu$. Simultaneously, crucible ($d_2$) or ($d_3$) are stepwise heated up to about 180° C. - 350° C. and held at this range (i.e., depending on the photoconductive material used) for about 1 - 10 minutes; the glow discharge is then terminated by shutting off the voltage. Subsequent coating of photoconductor material by simple evaporation condensation is optionally carried out at a somewhat lower pressure ($5 \times 10^{-4}$ Torr or better) at suitable crucible temperature in the manner previously indicated.

Although the thickness of the photoconductive layer obtained is positively correlated to the negative voltage applied to the rod or wire cathode, as above-described, optimal results are obtained with an AC or DC voltage of from about 1 - 4 KV, and preferably at about 2.5 KV, having a maximum current of about 20 to 25 ma and a minimum of about 0.2 -0.5 ma with a 1/8 inch × 15 inches solid aluminum plating rod. Under such conditions, the cathode rod will become hot enough to avoid deposition of any appreciable amount of selenium at the end of the run.

In a planetary system of rotating substrates above several 100 inches long chains of crucibles having one cathode rod per chain, it is found practical to utilize a maximum current of only about 167 ma/chain and a minimum current of about 6 ma/chain to obtain durable flexible photoconductor coating(s) on the corresponding substrates or bases. The results obtained indicate that a fully adequate supply of high energy photoconductor ions are produced.

The following examples specifically demonstrate preferred embodiments of the present invention without limiting it thereby.

EXAMPLE I

A nickel alloy test belt identified as A-1 and having a thickness of 4.5 mil (0.0045 inch), a length of 10 inches and a diameter of 4.75 inches is cleaned with a hot aqueous solution containing 10% by weight of "Mitchell Bradford #14 Cleaner" and then rinsed in deionized water for about 2 minutes.

Sample belt A-1 is mounted on a rotatable mandrel in a vacuum coater about 6 inches away from stainless steel crucibles equipped with resistive heating means and containing a photoconductor selenium alloy consisting essentially of about 99.5% selenium and 0.5% arsenic. Two high voltage glow cathodes (up to 5000v) are mounted about 3 inches from the test belt, the first (GB1) being directed essentially at the belt in the 10 o'clock position and the second (GB2) is mounted at similar distance but at about 5 o'clock relative to the belt as center and directed substantially at the interspace between the substrate belt and the stainless steel crucibles. After evacuating to $5 \times 10^{-5}$ Torr and backfilling the coater with 20 micron air pressure, negative 3,000 volts are applied to the first glow cathode (GB1) for about 10 minutes to heat and oxidize the belt. The first glow cathode voltage is turned off, coater pressure thereafter lowered to about 15 microns, the crucible heated up to 280° C., and the second glow cathode (GB2) (3500 volts) turned on for about 10 minutes. The second glow cathode is then turned off and straight vapor deposition permitted to proceed at reduced pressure ($5 \times 10^{-5}$ Torr) for about 25 minutes to obtan a total uniform photoconductor coating about 50 microns thick. During both steps, the mandrel is constantly rotated at about 10 revolutions per minute to obtain uniform exposure. The belt is then cooled, removed from the coater, tested for electrical properties and flex, and the results reported in Table I infra.

EXAMPLE II

Two nickel test belts of essentially identical size and shape as test belt A-1, and identified as A-2 and A-3, are cleaned as in Example I and coated as follows:

Belt A-2 is coated as in Example I except that a 30$\mu$ backfill of oxygen (5% by volume) and argon (95% by volume) is utilized in place of air during the initial heating and oxidation of the belt under the first glow cathode (GB1) and partial coating under the second glow cathode.

Belt A-3 (control) is treated identically as A-1 in Example I except that the second step (i.e., the initial deposition of photoconductor material onto the oxidized substrate) is effected for 35 minutes at $5 \times 10^{-5}$ Torr without utilization of a glow cathode. After depositing about 50 microns of the photoconductive material, the belt is cooled, removed from the coater, tested as in Example I and reported in Table I.

TABLE I

| Test Belt | Capacitive Charge (v/$\mu$) | 20 Second Dark Decay v/sec | Mandrel Test* (1½" Diameter) |
|---|---|---|---|
| A-1 | 23 | 20 | P |

TABLE I-continued

| Test Belt | Capacitive Charge (v/μ) | 20 Second Dark Decay v/sec | Mandrel Test* (1½" Diameter) |
|---|---|---|---|
| A-2 | 21 | 16 | P |
| A-3 | 24 | 17 | F |

*P = pass (no cracks or spalls observed)
F = fail (one or more cracks or spalls observed)
Belt bent once around a 1½" pipe at room temperature.

EXAMPLE III

Example I is repeated using respectively stainless steel, aluminum and brass test belts of the same dimensions as A-1 and comparable test results are obtained.

EXAMPLE IV (Control)

Two nickel test belts identical to those used in Examples I - II and identified respectively as A-4 and A-5 are cleaned and rinsed as in Example I. Belt A-4 is then mounted on a rotating mandrel (10 rev/min) and placed in a vacuum coater at $5 \times 10^{-5}$ Torr on convenient proximity over a 15 inch resistance-heated floating crucible boat containing a selenium alloy (99.5% As — 0.5% As), which is raised stepwise to a temperature of 300° C. and held at this temperature for about 20 minutes. The belt and coater are then cooled to ambient conditions and the treated belt removed and tested for electrical properties and flex. The results are reported in Table II below.

EXAMPLE V

Figure 1D:
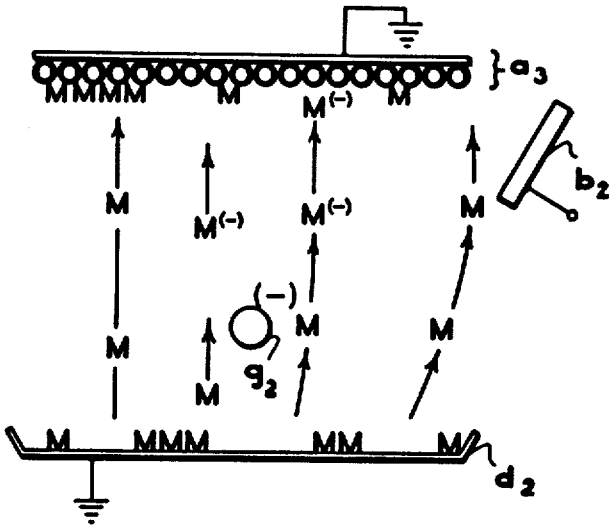

Belt A-5 is similarly mounted on a mandrel in a vacuum coater over a 15 inch grounded resistance-heated crucible boat of identical dimensions and containing the same composition selenium alloy as in Example IV. A bare ⅛inch × 15 inches solid aluminum rod is mounted on insulators 2 inches above the crucible in parallel axial alignment to its long axis and 6 inches from the mounted test belt (ref. FIGS. 1C - 1D). An aluminum glow cathode is also positioned to one side for preliminary electron bombardment of the substrate in the manner of FIG. 1C to first heat and uniformly oxidize the test belt. The coater is pumped down to 10μ pressure and the belt initially exposed to the aluminum glow cathode for 10 minutes followed by heating of the crucible to 230° C. and simultaneous activation of the bare solid aluminum rod at 2.5 KV DC to obtain an approximate rod shaped glow discharge. After 3 minutes, the current is turned off and the coating continued for 20 minutes as a simple evaporation-condensation step to give the desired thickness. The coater is then permitted to cool to ambient condition. The belt is removed, tested as before and the results reported in Table II.

TABLE II

| Test Belt | Capacitive Charge (v/μ) | 20 Second Dark Decay (v/sec) | Mandrel Test* (1½" diameter) |
|---|---|---|---|
| A-4 (control) | 20 | 17 | F |
| A-5 | 30.7 | 16 | P |

*P = pass (no cracks or spalls observed)
F = fail (one or more cracks or spalls observed)
When belt bent once around a 1½" pipe at room temperature

EXAMPLE VI

Two aluminum test belts identified as A-6 and A-7 and having the same dimensions as test belts used in the previous examples are cleaned and washed as before and then mounted side by side on a rotatable mandrel above two 15 inch crucibles containing the same photoconductive material as in Example V. Three ½ inch hollow (⅛ inch id) stainless steel tubes are mounted on insulators 2 inches, 3 inches and 2 inches respectively above the lips of the two crucibles as cathode rods in the manner shown schematically in FIGS. 1E and 1F. The rods, in turn, are arranged a maximum of about 10 inches below the exposed bottom plane of the aluminum belts being treated. The test belts are exposed to glow cathodes to heat and oxidize the surface and then bombarded with both uncharged vaporized photoconductor material and ionized vaporied photoconductor material in the manner of Example V at 1.8 KV DC for each cathode. After 3 minutes, the voltage is turned off and coating permitted to continue for 20 minutes as a single evaporation-condensation step and then the coater and test belts allowed to cool to ambient conditions for removal and testing as in Example V. The resulting coated belts are tested for flex as before and the results reported in Table III.

EXAMPLE VII

Figure 1E:
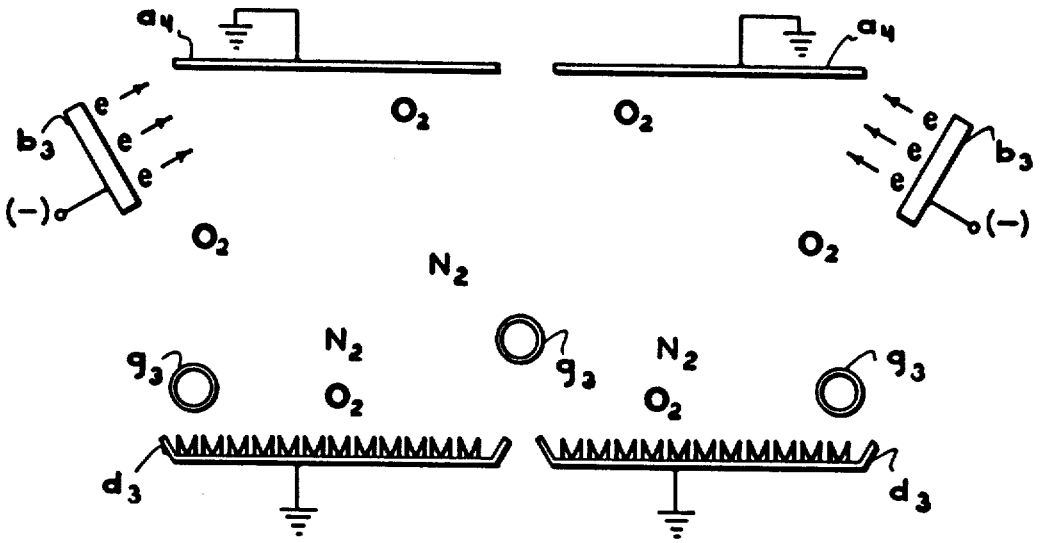
Figure 1F:
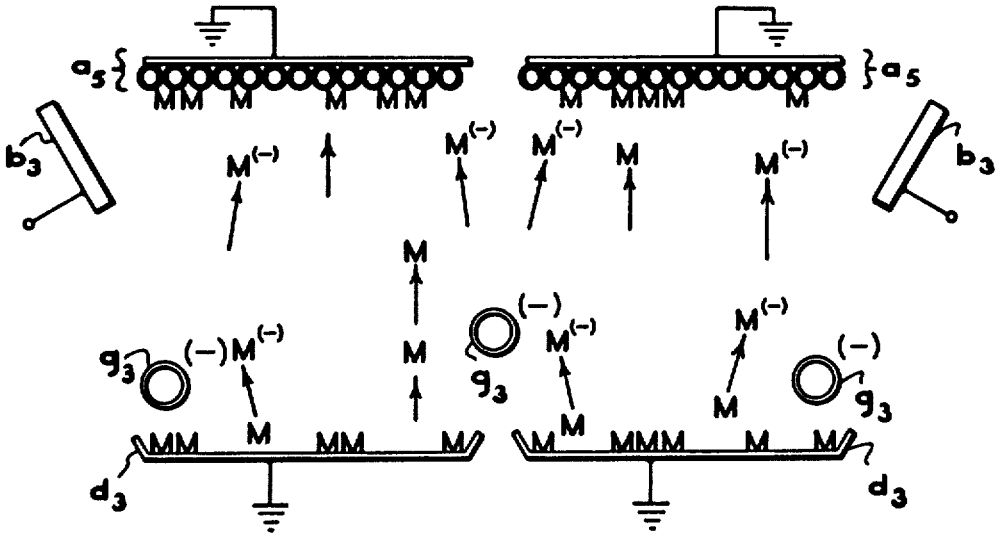

Example VI is repeated with identical test belts A-8 and A-9 using three 1/16 inch bare stainless steel wires in general accordance with FIGS. 1E and 1F. The wires, however, are uniformly arranged in parallel, 1 inch above each crucible lip rather than staggered as in the preceeding Example. After oxidation and deposition steps are completed, the belts are cooled, removed and tested as in Example VI. The flexibility and integrity of the coated belt is found to be comparable to that obtained with belts A-6 and A-7.

TABLE III

| Test Belt | Mandrel Test* |
|---|---|
| A-6 | P |
| A-7 | P |
| A-8 | P |
| A-9 | P |

*P = pass (no cracks or spalls observed when belt is bent once around a 1½" pipe at room temperature)

While the above Examples are directed to preferred embodiments of the invention, it will be understood that the invention is not limited thereby.

What is claimed is:

1. A method for obtaining flexible photoreceptors having improved durability and adhesion between a metal- or metal-coated substrate thereof, and a photoconductor layer thereof containing inorganic photoconductive material in charge blocking contact with the substrate, comprising exposing a clean oxide-coated conductive substrate to an ambient atmosphere consisting of one or more inert gases, a vapor cloud containing photoconductive material in a glow discharge, said atmosphere being nonreactive with said photoconductive material so that no new photoconductive materials are formed during said glow discharge.

2. The method of claim 1 wherein high energy ions of photoconductive material are produced in the glow discharge formed by at least one high voltage electrode, said electrode being negative with respect to the substrate and being conveniently mounted between the donor source and the substrate.

3. The method of claim 2 wherein the high voltage electrode is rod-shaped or a wire electrode arranged in parallel long axial arrangement with respect to at least one heated photoconductor-material-containing crucible boat.

4. A method for obtaining flexible photoreceptors having improved durability and adhesion between components thereof and containing a metal- or metal-coated substrate and a photoconductor layer of an inorganic photoconductive element or alloy thereof in charge blocking contact with the substrate, comprising initially bombarding said substrate with electrons and gas ions under glow discharge in the presence of an ambient atmosphere of air or a mixture of oxygen with at least one inert nonmetallic ion-forming gas; and exposing the resulting oxidized substrate to a vapor cloud containing photoconductor material in a glow discharge consisting of one or more inert gases.

5. The method of claim 4, wherein initial ion bombardment of the substrate is effected at a pressure of about 5 - 30 microns, the amount of of oxygen present being not less than about 1% by volume of available gases.

6. The method of claim 1 wherein exposure of the oxide-coated substrate is effected by heating the photoconductor material to a temperature up to about 350° C and high energy ions are obtained by establishing a glow discharge in the vapor cloud produced from a photoconductor source, said glow discharge being between at least one cathode and said source and substrate or another electrode, said source, substrate or other electrode having a positive potential through ground with respect to said cathode.

7. The method of claim 4 wherein the substrate is a charge conductive metal belt and the inorganic photoconductor material comprises at least one of selenium, tellurium, antimony, bismuth or corresponding alloys thereof.

8. The method of claim 4 wherein the substrate is a charge conductive metal belt and the photoconductor material comprises selenium or a selenium-arsenic-halogen alloy.

9. The method of claim 5 wherein additional photoconductor material is applied to the substrate by vapor deposition of uncharged photoconductor material.

10. The method of claim 1 wherein photoconductive material is deposited on the oxide-coated substrate under glow discharged to a thickness of at least about $0.01\mu$, the balance being deposited by vapor deposition.

11. The method of claim 10 wherein the oxide-coated substrate is exposed to a glow discharge both prior to and during at least some exposure of the substrate to a vapor cloud of photoconductive material.

12. A flexible photoreceptor comprising a metal- or metal-coated substrate and a photoconductor layer of an inorganic photoconductive material in good charge blocking contact with the substrate, obtained in accordance with the method of claim 1.

13. A flexible photoreceptor comprising a metal- or metal-coated substrate and a photoconductive layer of a heavy ionizable inorganic photoconductive material in good charge blocking contact with the substrate obtained in accordance with the method of claim 3.

14. A flexible photoreceptor comprising a metal- or metal-coated substrate and a photoconductive layer of a heavy ionizable inorganic photoconductive material in good charge blocking contact with the substrate obtained in accordance with the method of claim 4.

15. A flexible photoreceptor comprising a nickel or brass substrate and a photoconductive layer of a heavy ionizable inorganic photoconductive material in good charge blocking contact with the substrate obtained in accordance with the method of claim 10.

16. A flexible photoreceptor comprising a nickel or brass substrate and a photoconductive layer of a heavy ionizable inorganic photoconductive material in good charge blocking contact with the substrate obtained in accordance with the method of claim 11.

* * * * *